US009498822B2

(12) United States Patent
Brandt et al.

(10) Patent No.: US 9,498,822 B2
(45) Date of Patent: Nov. 22, 2016

(54) CONTINUOUS CASTING EQUIPMENT

(75) Inventors: Mathieu Brandt, Liege (BE); Jean-Paul Fischbach, Neupre (BE); Paul Naveau, Alleur (BE)

(73) Assignee: Arcelormittal Investigacion Y Desarrollo, S.L., Sestao Bizkaia (ES)

( * ) Notice: Subject to any disclaimer, the term of this patent is extended or adjusted under 35 U.S.C. 154(b) by 0 days.

(21) Appl. No.: 14/385,058

(22) PCT Filed: Mar. 28, 2012

(86) PCT No.: PCT/IB2012/000623
§ 371 (c)(1),
(2), (4) Date: Jan. 23, 2015

(87) PCT Pub. No.: WO2013/144667
PCT Pub. Date: Oct. 3, 2013

(65) Prior Publication Data

US 2015/0144291 A1 May 28, 2015

(51) Int. Cl.
*B22D 11/103* (2006.01)
*B22D 11/112* (2006.01)
(Continued)

(52) U.S. Cl.
CPC ..... *B22D 11/103* (2013.01); *B22D 11/112* (2013.01); *B22D 41/50* (2013.01); *B22D 41/60* (2013.01)

(58) Field of Classification Search
CPC .. B22D 11/103; B22D 11/108; B22D 11/112
USPC ..... 164/473, 461; 222/606, 607
See application file for complete search history.

(56) References Cited

U.S. PATENT DOCUMENTS 4,874,471 A 10/1989 Wilmotte
4,995,446 A 2/1991 Naveau et al.
(Continued)

FOREIGN PATENT DOCUMENTS

BE 1012037 A3 4/2000
BE 1014063 A3 * 3/2003 ..... B22D 11/108
(Continued)

OTHER PUBLICATIONS

Chatterjee et al., Physical and Mathematical Modeling of Two-Phase Flows in a Hollow Jet Nozzle, Oct. 2007, Metallurgical and Materials Transactions B, vol. 38B, pp. 819-831.*
(Continued)

*Primary Examiner* — Kevin E Yoon
*Assistant Examiner* — Jacky Yuen
(74) *Attorney, Agent, or Firm* — Davidson, Davidson & Kappel, LLC

(57) ABSTRACT

Continuous casting equipment for a flow of liquid metal from a tundish into a mold is provided. The equipment includes a vertical duct disposed upstream of the mold with respect to the direction of travel of the liquid metal. The duct includes from upstream to downstream a refractory ring, a copper tube with an internal diameter D and a submerged entry nozzle. A dome is disposed inside the refractory ring and includes a sloped upper part, the upper part is defined so as to deflect the liquid metal coming from the tundish towards the inner walls of the vertical duct. The diameter D of the copper tube ranges between a minimum diameter equal to Q/3.75 and a maximum diameter equal to Q/1.25, where Q is the nominal liquid metal flow rate of the equipment and is between 200 and 800 kg/min and D is the diameter expressed in mm.

7 Claims, 4 Drawing Sheets

(51) Int. Cl.
*B22D 41/50* (2006.01)
*B22D 41/60* (2006.01)

(56) References Cited

U.S. PATENT DOCUMENTS 5,716,538 A * 2/1998 Poloni ..... B22D 41/50
164/437
5,954,989 A * 9/1999 Brook ..... B22D 41/54
222/600

FOREIGN PATENT DOCUMENTS

EP 0269180 A2 6/1988
EP 0605379 B1 7/1997
EP 2099576 B1 5/2010
GB 2347886 A * 9/2000 ..... B22D 11/112
WO 2008070935 A1 6/2008

OTHER PUBLICATIONS

Naveau P. "Developpement d'un echangeur de chaleur pour coulee avec surchauffe faible." Revue de Metallurgie—Cahiers d'Informations Techniques, Revue de Metallurgie. Paris, FR. vol. 90, No. 3. Jan. 3, 1993. pp. 395-401, XP000369722. See p. 396, published in English.

Naveau P. "Developpement d'un echangeur de chaleur pour coulee avec surchauffe faible." Revue de Metallurgie—Cahiers d'Informations Techniques, Revue de Metallurgie. Paris, FR. vol. 90, No. 3. Jan. 3, 1993. pp. 395-401, XP000369722.

* cited by examiner

CONTINUOUS CASTING EQUIPMENT

The present invention relates to continuous casting equipment. In particular, the invention relates to continuous casting equipment, called Hollow Jet Nozzle, with an improved new design.

BACKGROUND

The continuous casting of steel is a well-known process. It consists in pouring a liquid metal from a ladle into a tundish intended to regulate the flow and then, after this tundish, in pouring the metal into the upper part of a water-cooled bottomless copper mould undergoing a vertical reciprocating movement. The solidified semi finished product is extracted from the lower part of the mould by rollers. The liquid steel is introduced into the mould by means of a tubular duct called a nozzle placed between the tundish and the mould.

Document EP 0 269 180 B1 describes a specific continuous casting equipment called "Hollow Jet Nozzle" (see reference FIG. 1) in which the liquid metal is poured onto the top of a dome 2 made of a refractory material. The shape of this dome 2 causes the metal to flow towards its periphery, the flow being deflected towards the internal wall of the nozzle or of an intermediate vertical tubular member. Said intermediate vertical tubular member can be a copper tube 3 cooled by a water jacket 4 as illustrated in FIG. 1 and topped by a refractory ring 5. What is thus created, in the central part of the nozzle beneath the tundish member, is a volume without any liquid metal within which it is possible to carry out additions via an injection channel. One or several support arms are located on the upper part of the dome 2 to secure it to said refractory ring 5. The water-cooled copper tube 3 forms a heat exchanger that extracts heat from the liquid steel. As a consequence, the superheat of the liquid steel is drastically reduced close or even below the liquidus temperature.

A powder can be injected in the center of the hollow jet created by the refractory dome 2. This injection technique is disclosed in the document EP 0 605 379 B1. This powder injection aims to create an additional cooling of the liquid steel by the melting of the metallic powder or to modify the composition of the steel during casting by addition of other metallic elements such as ferro-alloys. As disclosed in document EP 2 099 576 B1, the powder can be transported via a mechanical screw feeder and is fed by gravity through one of the support arms of the refractory dome and through the refractory dome itself.

In the present application the term HJN equipment will be understood as describing the elements as described in FIG. 1 excepting the powder container 10 and the powder feeder 11.

During casting sequences using the HJN as previously described the equipment has to be frequently stopped because of the irregular flow of the liquid steel from the tundish 1 to the mould 9 and/or because of the irregular injection of powder, implying instability of the casting process and which could lead to the clogging of the HJN or to the clogging of the outlet of the powder injector.

SUMMARY OF THE INVENTION

An object of the present invention is to provide continuous casting equipment allowing a regular and stable casting process.

The present invention provides a continuous casting equipment for a flow of liquid metal from a tundish into a mould, the equipment includes a vertical duct disposed upstream of the mould with respect to the direction of travel of the liquid metal, the duct including from upstream to downstream a refractory ring, a copper tube with an internal diameter D and a submerged entry nozzle. The equipment also includes a dome disposed inside the refractory ring and comprising a sloped upper part, said upper part being defined so as to deflect the liquid metal coming from the tundish towards the inner walls of the vertical duct. The diameter D of the copper tube ranges between a minimum diameter equal to Q/3.75 and a maximum diameter equal to Q/1.25, where Q is the nominal liquid metal flow rate of the equipment and is between 200 and 800 kg/min and D is the diameter expressed in mm.

In further preferred embodiments, taken alone or in combination the equipment may also include the following features:

- the slope $\alpha$ of the upper part of said dome ranges from 30 to 10°;
- said dome further comprises a lateral side extending from the upper part of the dome down to a bottom part of the dome, said lateral side forming at the intersection with the upper part a sharp fillet with a radius of curvature of 2 mm or less;
- the gap e between said sharp fillet and the refractory ring ranges from 10 to 25 mm;
- the distance h between the bottom of the dome and the top of the copper tube ranges from 10 to 50 mm;
- said upper part of the dome further comprises at least a support arm with a fixing part to secure said dome to the refractory ring, said fixing part having a width C ranging from 10 to 60 mm;
- said at least support arm comprises an additional part extending from the fixing part along the lateral side of the dome, said part being designed so that it directs the flow of liquid metal around the support arm and below said arm;
- said additional part has converging lateral walls; and
- the dome is made up of high alumina.

The present invention also discloses a continuous casting process of a liquid metal at a nominal flow rate of Q comprised between 200 and 800 kg/min using an equipment as described above including a copper tube with an internal diameter D which has a value ranging between a minimum diameter equal to Q/3.75 and a maximum diameter equal to Q/1.25.

The inventors discovered that the perturbations in the casting process are linked to an inappropriate design of the hollow jet nozzle.

BRIEF DESCRIPTION OF THE DRAWINGS

Other features and advantages of the present invention will become apparent on reading the following detailed description given solely by way of non-limiting example, with reference to the appended figures in which.

Figure 1:
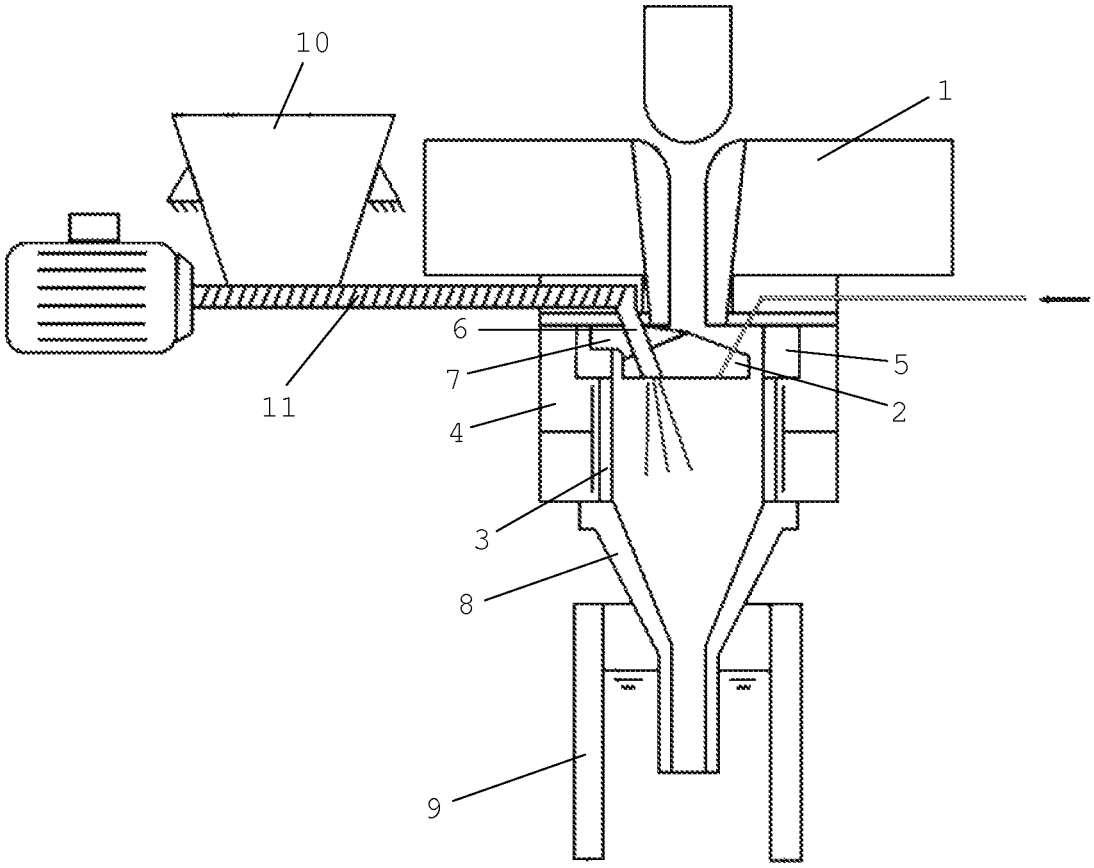
FIG.1 PRIOR ART
FIG. 1 is a section view of the continuous casting equipment according to the prior art.

LEGEND (1) Tundish
(2) Refractory dome
(3) Copper tube
(4) Water cooling jacket
(5) Refractory ring
(6) Feeding tube
(7) Support arm
(8) Submerged entry nozzle
(9) Mould
(10) Powder container
(11) Powder feeder
(12) Additional part
(13) Fillet of the refractory dome
(14) Fixing part of the support arm
(15) Lateral side of the dome
(16) Upper part of the dome
(17) Bottom part of the dome
(18) Skull

DETAILED DESCRIPTION

Figure 2:
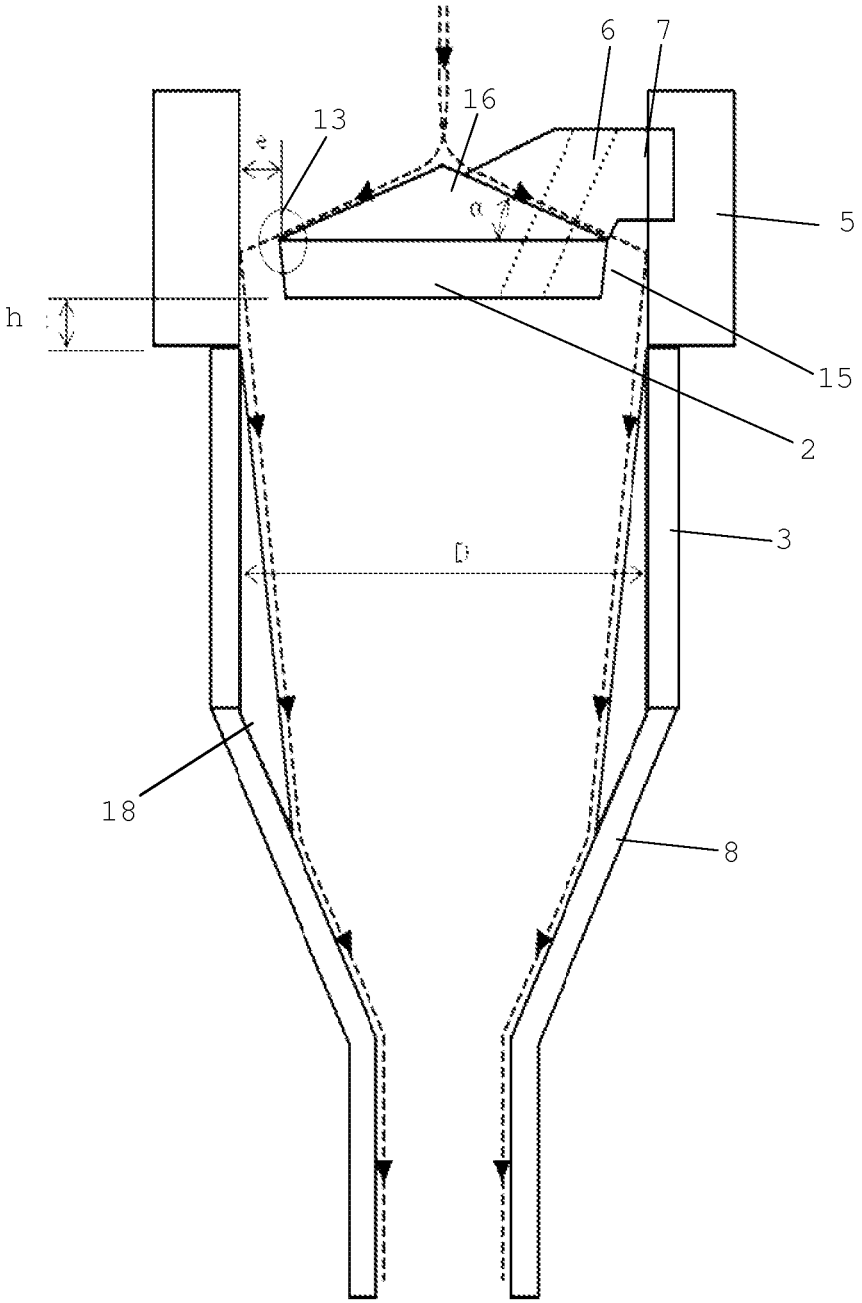
FIG. 2 is a section view of the continuous casting according to an embodiment of the invention.

As previously explained, and as can be seen on FIG. 2, the principle of the Hollow Jet Casting process lies notably on the fact that the water-cooled copper tube 3 extracts the heat from the liquid steel. This heat extraction creates a layer of solidified steel on the copper tube; this layer is called the skull 18. The liquid steel then flows inside the nozzle along this solidified skull 18 (the flow of the liquid steel is represented in dotted lines). This solidified skull is essential for the process but must not be too large compared to the diameter D of the copper tube 3 because of a risk of clogging of the nozzle which would disturb the liquid steel flow.

In order to maximize the heat extracted by the copper tube and to reduce the risk of clogging of the nozzle, the inventors discovered that said diameter D has to be chosen in function of the nominal steel flow rate of the continuous casting equipment. An adequate ratio between the nominal steel flow rate and the diameter D ensures a stable formation of a homogeneous and thin layer of liquid steel along the copper tube. According to the invention, the diameter D has to be selected between a minimum diameter of Q/3.75 and a maximum diameter of Q/1.25 ($Q/3.75 \leq D \leq Q/1.25$), where Q is the nominal steel flow rate in kg/min comprised between 200 to 800 kg/min and D the diameter in mm. For example, a diameter D of 195 mm can be selected for a nominal steel flow rate of 400 kg/min. As a result, the average heat flux extracted by the heat exchanger is of 0.9 $MW/m^2$ for a steel superheat in the tundish of 30° C.

A major improvement is already observed when the diameter D respects the above-mentioned range, but in addition, one or several of other criteria can be fulfilled to further improve the regularity of the liquid flow and of the powder injection in the continuous casting equipment according to the invention.

Figure 3:
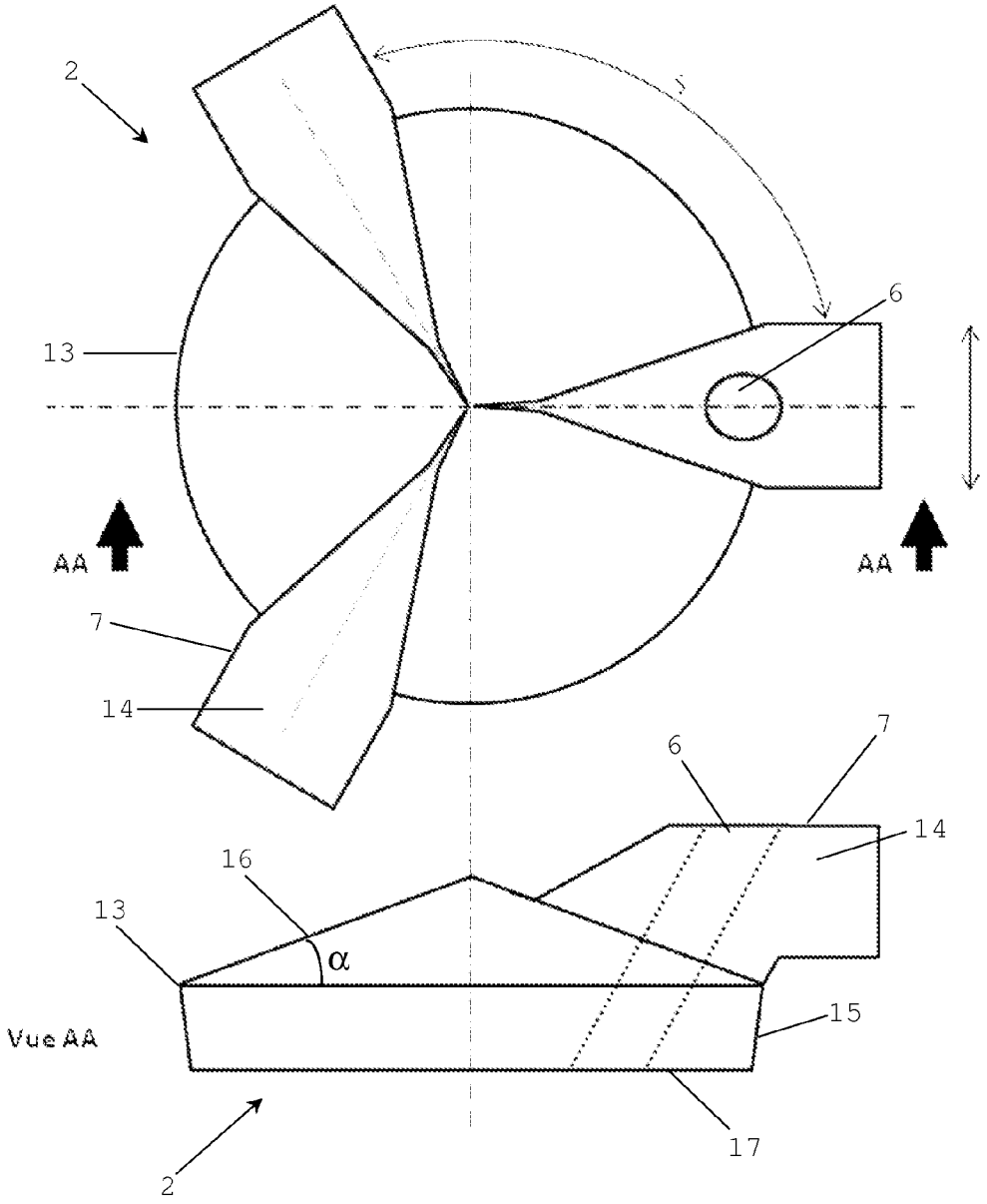
FIG. 3 is a top view of the dome according to an embodiment of the invention. A section view of the dome according to the axis AA-AA is also represented.

As illustrated in FIG. 3 the dome 2 includes an upper part 16 with a slope α which receives and deflects the liquid steel towards the wall of the copper tube to create the hollow jet, a bottom part 17 which allows to inject the powder as close as possible to the center of said hollow jet, and one or several support arms 7 designed to secure the dome 2 to the refractory ring.

The slope α of the refractory dome 2 is designed in order to ensure a good and stable impact of the liquid steel jet on the vertical refractory ring 5 and to reduce the perturbation of the liquid steel over the dome 2. According to the invention, the slope ranges from, for example, 30 to 10°, preferably from 25 to 15° and, more preferably, the slope is of 20°.

In addition, the fillet 13, as illustrated in FIG. 3, formed by the junction of the upper part 16 and the lateral side 15 of the bottom part 17 of the dome 2 is preferably sharp to insure a rectilinear and straight steel flow when the liquid metal flows out of the upper part of the dome and to ensure thereby a good impact of the steel on the refractory ring. Preferably, the curvature radius of the fillet 13 is 2 mm or less and, more preferably, 1 mm or less. The material of the dome has to be strong enough so as to keep this fillet sharp during the whole casting sequence. Preferably, the dome 2 is made up of high alumina material.

The gap e, as illustrated in FIG. 2, between the dome 2 and the vertical refractory ring 5 has also an impact over the liquid flow. This gap e must be large enough to avoid the formation of steel plugs between the dome 2 and the vertical refractory ring 5 but not too large. If this gap is too large, the liquid steel cannot reach the refractory ring 5. According to the present invention, the gap e between the fillet 13 of the dome 2 and the vertical refractory ring 5 ranges from, for example, 10 to 25 mm, preferably from 13 to 20 mm and, more preferably, the gap is of 15 mm.

It is also advantageous to foresee a minimum distance h, as illustrated in FIG. 2, between the bottom of the refractory dome 2 and the top of the copper tube 3 in order to avoid problems of clogging at the exit of the gap between the dome 2 and the refractory ring 5 and to avoid problems of non desired solidification of liquid steel below the dome 2 which could disrupt the good injection of the powder in the centre of the nozzle. This distance h ranges from, for example, 10 to 50 mm, preferably from 15 to 35 mm, and, more preferably, is of 30 mm.

The support arm(s) of the dome can also disrupt the liquid flow under the dome, what can lead to a non desired solidification of liquid steel below the dome. This uncontrolled solidification can interfere with the injected powder and disrupt the powder supply in the hollow jet. The number, the dimensions and the shape of said support arms have to be chosen to avoid these problems.

Figure 4:
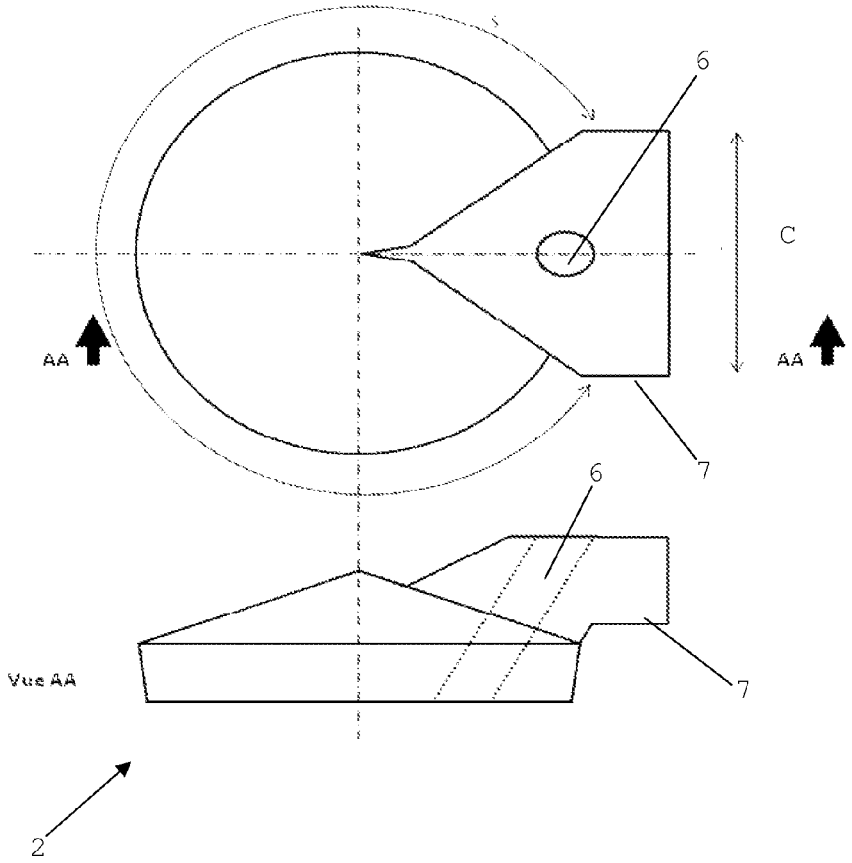
FIG. 4 is a top view of the dome according to another embodiment of the invention. A section view of the dome according to the axis AA-AA is also represented.

The number of arms can vary between one as shown in FIG. 4 and six always to insure a good flow of the liquid steel from the tundish to the copper tube. The preferred configuration is the configuration with three arms. In this configuration, the liquid flow is symmetrically deflected by the dome and the load on the arms is well distributed.

As illustrated in the section view of FIG. 3 the support arm 7 is disposed on the upper part 16 of the dome 2. It extends from the center of this upper part up to an area outside of the dome 2. The support arm 7 comprises a fixing part 14 disposed in the area outside of the dome 2 and defined to secure the support arm 7 to the refractory ring of the vertical duct.

This fixing part 14 has a width C which has to be kept as small as possible in order to maximize the steel flow area along the copper tube circumference while keeping a good support function. The width C can vary between, for example, 10 and 60 mm depending on the number of arms. For example, in a configuration with three arms like in FIG.

3, the width C of the arm is of 40 mm. These arms are separated by an arc length S always equal between two arms in order to insure a symmetrical flow of the liquid steel. The steel flow area is then equal to three times the arc length S separating two arms.

Figure 5:
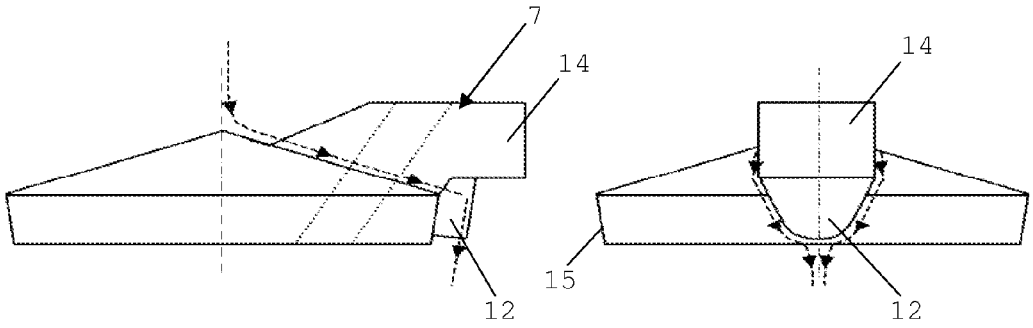
FIG. 5 is a section view and a side view of the dome according to another embodiment of the invention.

In FIGS. 3 and 4, the support arm 7 only extends on the upper part 16 of the dome 2. In this configuration, the steel flow is disturbed by the arm 7 and an area without liquid steel is formed below the arm 7. To direct the flow of liquid steel around the arm 7 and below this arm as shown in FIG. 5, the support arm 7 can comprise an additional part 12 extending from the fixing part 14 along the lateral side 15 of the dome 2. The shape of this additional part 12 is designed so that the liquid metal flowing around the arm tends to converge below the arm. Preferably, this additional part 12 has converging lateral walls. This design improves the homogeneity of the liquid steel flow along the copper tube circumference and maximizes the heat extracted by the heat exchanger.

The present invention has been illustrated for continuous casting of steel but can be extended to casting of other metals or metal alloys, such as copper.

What is claimed is:

1. Continuous casting equipment for a flow of liquid metal from a tundish into a mould, the equipment comprising:

a vertical duct disposed upstream of the mould with respect to the direction of travel of the liquid metal, the duct including from upstream to downstream a refractory ring, a copper tube with an internal diameter D and a submerged entry nozzle; and a dome disposed inside the refractory ring and including a sloped upper part, the sloped upper part being defined so as to deflect the liquid metal coming from the tundish towards inner walls of the vertical duct;

the diameter D of the copper tube ranging between a minimum diameter equal to Q/3.75 and a maximum diameter equal to Q/1.25, where Q is a nominal liquid metal flow rate of the equipment and is between 200 and 800 kg/min and D is the diameter expressed in mm, a slope $\alpha$ of the sloped upper part of the dome ranges from 25 to 15°, the sloped upper part of the dome including at least one support arm with a fixing part to secure the dome to the refractory ring, the fixing part having a width C ranging from 10 to 60 mm, the at least one support arm having an additional part extending from the fixing part along a lateral side of the dome, the additional part being designed to direct the flow of liquid metal around and below the at least one support arm.

2. The continuous casting equipment according to claim 1, wherein the dome further comprises a lateral side extending from the upper part of the dome down to a bottom part of the dome, the lateral side forming at the intersection with the upper part a sharp fillet with a radius of curvature of 2 mm or less.

3. The continuous casting equipment according to claim 2, wherein a gap e between the sharp fillet and the refractory ring ranges from 10 to 25 mm.

4. The continuous casting equipment according to claim 2, wherein a distance h between the bottom of the dome and a top of the copper tube ranges from 10 to 50 mm.

5. The continuous casting equipment according to claim 1, wherein the additional part has converging lateral walls.

6. The continuous casting equipment according to claim 1, wherein the dome is made up of high alumina.

7. A continuous casting process for a flow of liquid metal at a nominal flow rate of Q between 200 and 800 kg/min comprising the steps of:

using the continuous casting equipment according to claim 1.

* * * * *